US006766668B2

(12) United States Patent
Sinykin

(10) Patent No.: US 6,766,668 B2
(45) Date of Patent: Jul. 27, 2004

(54) SILVER-KNIT MATERIAL

(76) Inventor: Daniel L. Sinykin, 9610 Lake Dr., Bayside, WI (US) 53217

( * ) Notice: Subject to any disclaimer, the term of this patent is extended or adjusted under 35 U.S.C. 154(b) by 190 days.

(21) Appl. No.: 10/196,449

(22) Filed: Jul. 16, 2002

(65) Prior Publication Data

US 2004/0014387 A1 Jan. 22, 2004

(51) Int. Cl.[7] ..... D04B 9/12
(52) U.S. Cl. ..... 66/191; 66/9 R
(58) Field of Search ..... 66/8, 9 R, 10–12, 66/9 A, 9 B, 61, 80, 83, 190, 191, 194; 442/312, 313

(56) References Cited

U.S. PATENT DOCUMENTS 1,114,414 A 10/1914 Tauber
2,737,702 A * 3/1956 Arnold et al. ..... 428/89
3,299,672 A 1/1967 Schmidt
3,674,618 A * 7/1972 Spann ..... 428/91
3,894,407 A 7/1975 Clingan et al.
3,894,409 A 7/1975 Clingan et al.
3,922,410 A 11/1975 Halloran
4,236,286 A * 12/1980 Abler et al. ..... 28/160
4,415,611 A * 11/1983 Yamagata et al. ..... 428/15
4,418,104 A 11/1983 Kiyomura et al.
4,953,250 A 9/1990 Brown
5,707,906 A 1/1998 Eschenbach
6,048,422 A 4/2000 Kim, II et al.
6,151,920 A 11/2000 Schindler et al.

* cited by examiner

*Primary Examiner*—Danny Worrell
(74) *Attorney, Agent, or Firm*—Foley & Lardner LLP

(57) ABSTRACT

A sliver-knit material is formed from a base including at least one thread having a first material and a second material. The first material has a melting point lower than the second material. A sliver material is secured to the base. A portion of the sliver material is encapsulated by the first material.

20 Claims, 2 Drawing Sheets

FIG. 1
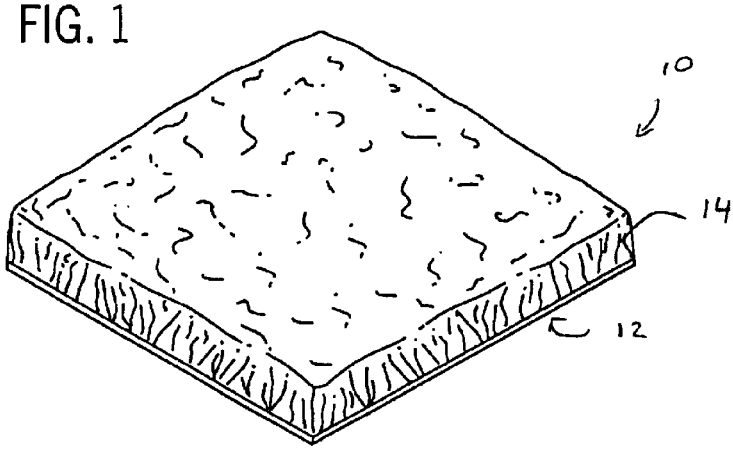
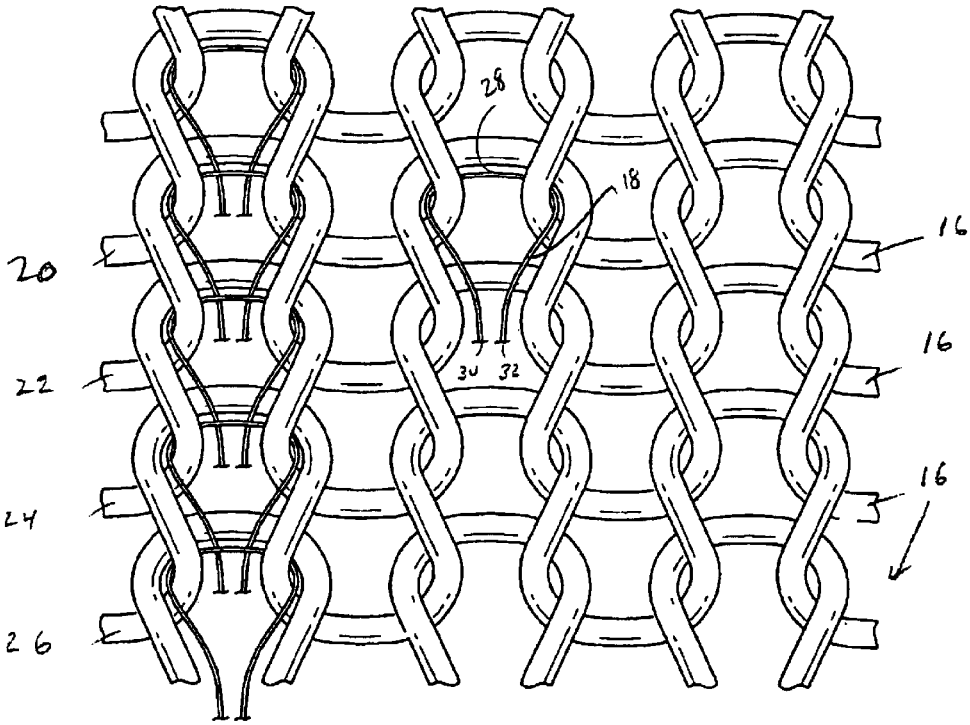
FIG. 2

SILVER-KNIT MATERIAL

CROSS-REFERENCE TO RELATED PATENT APPLICATIONS

None.

BACKGROUND OF THE INVENTION

The present invention relates generally to the field of sliver-knit material and more particularly, to sliver-knit paint roller fabric. Sliver-knit material is a well known product that is used in a number of different applications, including floor coverings, apparel, cleaning mitts, pet beds and as a paint roller material.

A sliver-knit material typically includes a knitted base and a plurality of fibers captured between the stitches of the knitted base. The fibers may be synthetic or natural and are often blended to achieve the desired color and desired physical characteristics. The blended fibers are oriented in a single direction on a carding machine and formed into a continuous rope of sliver that is fed into the knitting machines.

Depending on the size and type of the knitting machine, a number of different knitting heads may be used in the knitting process. Each knitting head receives a separate spool of thread. As the threads are knitted, sliver material is pulled into a knit, so that a loop is formed about the stitch and the sliver is captured in the knitted material. The free ends of the sliver extend upward away from the knitted material.

If the slivers are off center or if the slivers are not tightly captured within the knit, some slivers may work their way free of the knitted material and shed as the sliver-knit material is used. The fibers that are not securely captured in the knitted material are removed in a combing operation. In order to further reduce the shedding of the slivers that are not removed during the combing operation a binder material such as latex or acrylic is applied to the bottom side of the knitted material opposite the free ends of the slivers. The binder material serves to encapsulate the looped portion of the slivers and the knitted material. However, since the binder material is applied only to the bottom of the knitted material it is not possible to fully surround the slivers. After repeated use of the sliver material, a certain amount of the slivers will work their way free of the binder and shed. Shedding of slivers is undesirable for a number of reasons. If the sliver-knit material is being used as an apparel, any significant shedding may result in the degradation of the material, or unsightly deposit of slivers on adjoining materials.

Shedding of slivers when the sliver-knit material is being used as paint roller fabric may result in slivers being deposited onto a painted surface. Accordingly, it would be desirable to provide a sliver knit material and a method to produce the sliver-knit material in which shedding of slivers was minimized.

SUMMARY OF THE INVENTION

One embodiment of the invention relates to a sliver-knit material in which at least a portion of the threads of the knitted based are melted about the slivers.

Another embodiment of the invention relates to a sliver-knit material comprising a base including at least one thread having a first material and a second material. The first material has a melting point lower than the second material.

A sliver material is secured to the base with a portion of the sliver material being encapsulated by the first material.

A further aspect of the invention includes a method for forming a sliver-knit material. A base material is knitted with a thread having a first material with a predetermined melting point and a second material having a melting point higher than the first material. Slivers are captured within the base material. The captured slivers and knitted base material is heated to a temperature at least as high as the predetermined melting temperature for a period of time sufficient to melt at least a portion of the first material to flow about a portion of the slivers. The first material is cooled thereby securing a portion of the slivers within the first material.

BRIEF DESCRIPTION OF THE DRAWINGS

FIG. 1 is a perspective view of a sliver-knit material.

FIG. 2 is a schematic view of the bottom of the sliver-knit material.

DETAILED DESCRIPTION OF THE PREFERRED EMBODIMENTS

Figure 3:
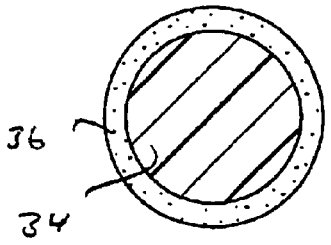
FIG. 3 is a cross-sectional view of a thread of the sliver-knit material.

Referring to FIG. 1, a sliver-knit material 10 includes a base 12 and a sliver portion 14 secured to and extending form the base 12. The sliver-knit material is formed in a traditional sliver-knitting process. As schematically illustrated in FIG. 2, base 12 is formed from a plurality of threads 16. In a preferred embodiment, the sliver-knit material is formed in a circular knitting machine, in which a number of knitting heads are used to feed the threads. Each knitting head employs a separate spool of thread. Accordingly, it is possible to use different types of threads up to the number of knitting heads that are used in the particular knitting machine.

In the embodiment illustrated in FIG. 2 a group of slivers 18 is looped around a first thread 20 and fed over two subsequent threads 22, 24 before being captured between the third thread 24 and fourth thread 26 after which it extends in an upward direction. The group of slivers 18 includes a loop portion 28 and two terminal end portions 30, 32.

In a first embodiment, illustrated in FIG. 3 the threads 16 include an internal material 34 that is covered with a plastic coating 36 that has a melt temperature that is lower than the melt temperature of the slivers and of the internal material 34.

The internal material 34 may be formed from a polyester core. The outer coating 36 may be formed with a polypropylene material having a melt temperature less than the melting temperature of the polyester core and of the slivers.

Figure 4:
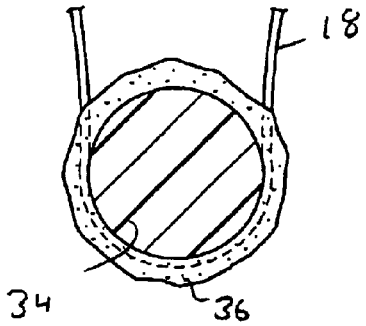
FIG. 4 is a cross-sectional view of a sliver-knit material after the low-melt portion of the thread has been melted.

The sliver-knit material is subsequently heat treated to a temperature to permit the plastic coating 36 to melt. At this temperature the plastic coating 36 flows around the portion of the slivers that are in contact with the threads. As the material is cooled, the slivers are encapsulated within the plastic coating 36 (See FIG. 4). As a result the slivers are locked within the threaded base to prohibit the slivers from being removed or shedding from the base as the sliver-knit material is used.

Figure 5:
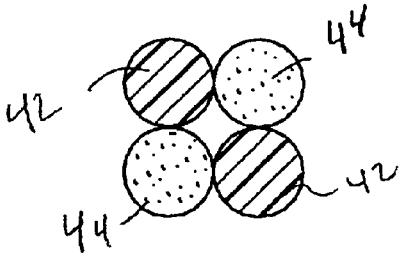
FIG. 5 is a cross-sectional view of an alternative embodiment of a thread having a plurality of stands, some of which are formed of a low melt material.

Referring to FIG. 5, of each thread 26 may include a plurality of filaments or strands. Although only four strands are illustrated in FIG. 5 it is understood that the number of strands could be much greater. Some of the strands 42 are formed from a high melt material and some of the strands 44 are formed from a low melt material. The low melt strands 44 will melt and flow around the slivers as it is melted. The high melt strands 42 will not melt during this process and will help to retain the flexible nature of the overall sliver-knit material.

Figure 6:
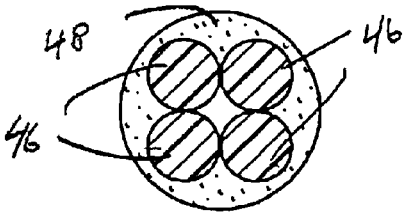
FIG. 6 is a cross-sectional view of an alternative embodiment of a thread having a plurality of strands encapsulated with a low melt material.

In another embodiment illustrated in FIG. 6 the thread is formed from a plurality of high melt strands 46. All of the high melt strands 46 are collectively encapsulated with a low melt outer covering 48, such that the low melt material is applied around the aggregate of all of the strands 46.

Figure 7:
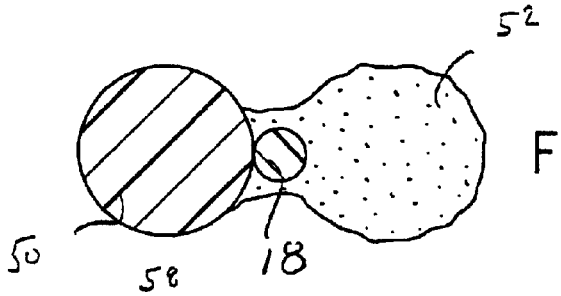
FIG. 7 is a cross-sectional view of a sliver-knit material with a low melt thread melted about a sliver and an adjacent high melt thread.

In still another embodiment illustrated in FIG. 7 the adjacent threads are formed from different materials. For example, one thread 50 may be formed of a high melt material while a second adjacent thread 52 may be formed of a low melt material. It is also possible for adjacent threads to have single or multiple strands of different combinations of low and high melt materials. The low melt thread 52 melts about the sliver 18 and adjacent thread 50 thereby encapsulating the sliver 18.

Figure 8:
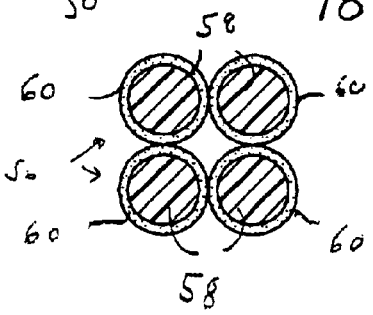
FIG. 8 is a cross-sectional view of a sliver-knit material with each thread including a plurality of strands each coated with a low melt material.

As illustrated in FIG. 8, another embodiment of a thread is made up of a plurality of filaments or strands 56. In this embodiment, each stand 56 includes a high melt core 58 and a low melt outer covering 60. In one embodiment, each thread includes 72 strands. The high melt material is a polypropylene having a melting point above 160 degrees Celsius. Each strand 56 is surrounded by a low melt co-polyester material such as Eastarbio™ manufactured by Eastman Chemical and having a melting point of 108 degrees Celsius. In one embodiment, the center of the strand is 10 microns with a 5 micron coating of low melt co-polyester. The result is a coated strand having a diameter of 20 microns.

The core or high melt material illustrated in FIGS. 3, 5, 6 and 7 could be formed from polypropylene and the low melt material could be formed from a co-polyester material. However, other materials having a relative high and low melt characteristic could be employed as well.

The ratio of the low melt material to the high melt material should be such that a significant amount of the slivers are encapsulated during the melting process. However, it is desirable for the material to be flexible and not to be stiff after the melting operation. If all of the thread material was a low melt material, the entire base would become rigid after the material melted and was cooled. Having a sufficient amount of non-melting material in the threaded base allows the material to retain a flexible nature for subsequent use. Further, the melting point of the low melt material must be lower than the melting or burning temperature of both the slivers and the high melt material.

The method of manufacturing a sliver-knit material will now be addressed. In a first embodiment, the threads being fed to each knitting head in the sliver-knitting machine are all the same. As discussed above, the make up of each thread may vary. Each thread may include a central core of a first material having a melting temperature that is higher than the melting temperature of an outer covering. Additionally, if the first material is a natural fiber it may be that the first material does not have a melting temperature in that it is not prone to flowing at a certain temperature. Each thread may also be formed of more than one strand, where all the strands may be the same or the strands may be different within each thread. The strands may each have a central core of the first or high melt material, and fully covered by an outer covering of the low melt material. Alternatively, the outer covering may be intermittent in either or both of the circumference or longitudinal axis of the inner core. Additionally, some strands may include at least a portion of the first material or be comprised completely of the first material, while other strands do not include any of the first material, or include the first material to a less of a degree. Also the strands may be fully surrounded or partially surrounded by a single outer covering of the first material.

As the threads are knitted to form the base, sliver material is secured to the knitted base. Each group of slivers 18 is formed into a U-shape having a central portion 28, two free terminal ends 30, 32, and an intermediate portion extending between the central portion and the terminal ends. The central portion 28 is wrapped around a single thread and the intermediate portion extends over at least one other thread and captured between two threads as it extends upward toward the terminal ends. In the embodiment illustrated in FIG. 2 each intermediate portion of the group of slivers is thread over at least adjacent thread 24 and extends upward in between adjacent threads 24, 26.

The resulting sliver-knit material is then prepared for heating to activate the low melt material. The sliver-knit material may be sized to a desired width and length and placed in an oven. The sliver-knit material is heated to a temperature for a sufficient period of time to permit the low melt material to melt about the central and/or intermediate portion of the slivers.

The sliver-knit material is then cooled so that the low melt material returns to a hardened state and captures a portion of the slivers locking the slivers to the base. In a further embodiment, at least a portion of the slivers are fully encapsulated in the cooled low melt material. The slivers may be partially encapsulated such that only a portion of the circumference of a portion of the slivers are covered by the first material.

While only a single sliver strand is illustrated in FIG. 2 it is understood that each single sliver illustrated may represent a plurality of slivers. Further, while not every loop of thread in the knit illustrated in FIG. 2 includes a sliver it is also understood, that a group of slivers are engaged with each loop of the thread. Further, the specific manner in which the slivers are inserted within the knitted base may vary.

The ratio of the first material and second material permits the sliver-knit to retain sufficient flexibility for a particular application. For example if the sliver-knit material is to be used as a paint roller material, the sliver-knit material must be flexible enough to be wrapped around the roller frame. Additionally, if the sliver-knit material is to be used for apparel, the sliver-knit must be flexible enough to bend easily.

While the detailed drawings and specific examples describe exemplary embodiments of a sliver-knit material they serve the purpose of illustration only. For example, a traditional binder material may be added to the bottom of the knitted base prior to heating of the sliver-knit material to further increase the encapsulation and locking of the slivers to the knitted base. Further modifications may be made in the design, arrangement and combination of the elements without departing from the scope of the invention as expressed in the appended claims.

What is claimed is:

1. A sliver-knit material comprising:

a base including at least one thread having a first material and a second material, the first material having a melting point lower than the second material; and a sliver material secured to the base, a portion of the sliver material being encapsulated by the first material.

2. The sliver-knit material of claim 1, wherein the thread includes a center core of the second material, and an outer covering of the first material.

3. The sliver-knit material of claim 1, wherein the thread includes a plurality of strands.

4. The sliver-knit material of claim 3, wherein each strand includes a center core of the second material and an outer covering of the first material.

5. The sliver-knit material of claim 3, wherein the plurality of strands includes at least one strand formed from the first material and at least one strand formed from the second material.

6. The sliver-knit material of claim 3, wherein the plurality of strands are formed from the second material and a single outer casing formed from the first material surrounds the plurality of strands.

7. The sliver-knit material of claim 3, wherein the first material fully surrounds a portion of the sliver material.

8. The sliver-knit material of claim 3, wherein the sliver material includes at least one sliver having a central portion, two terminal end portions, and an intermediate portion there between; and the central portion being wrapped around a single thread, the intermediate portion being trapped between two other threads.

9. The sliver-knit material of claim 4, wherein the sliver material includes at least one sliver having a central portion, two terminal end portions, and an intermediate portion there between; and the central portion being wrapped around a single thread, the intermediate portion being trapped between two other threads.

10. The sliver-knit material of claim 5, wherein the sliver material includes at least one sliver having a central portion, two terminal end portions, and an intermediate portion there between; and the central portion being wrapped around a single thread, the intermediate portion being trapped between two other threads.

11. The sliver-knit material of claim 6, wherein the sliver material includes at least one sliver haying a central portion, two terminal end portions, and an intermediate portion there between; and the central portion being wrapped around a single thread, the intermediate portion being trapped between two other threads.

12. The sliver-knit material of claim 7, wherein the sliver material includes at least one sliver having a central portion, two terminal end portions, and an intermediate portion there between; and the central portion being wrapped around a single thread, the intermediate portion being trapped between two other threads.

13. A method for forming a sliver-knit material, comprising:

knitting a base material with a thread having a first material with a predetermined melting point and a second material having a melting point higher than the first material;

capturing slivers within the base material;

heating the captured slivers and knitted base material to a temperature at least as high as the predetermined melting temperature for a period of time sufficient to melt at least a portion of the first material to flow about a portion of the slivers;

cooling the first material and securing a portion of the slivers within the first material.

14. The method of claim 13, wherein the thread includes a center core of the second material and an outer covering of the first material.

15. The method of claim 13, wherein the thread includes a plurality of strands.

16. The method of claim 13, wherein each strand includes a central core of the second material and an outer covering of the first material.

17. The method of claim 13, wherein the plurality of strands includes at least one strand formed from the first material and at least one strand formed from the second material.

18. The method of claim 13, wherein the plurality of strands are formed from the second material and a single outer casing formed from the first material surrounding the plurality of strands.

19. The method of claim 13, wherein at least one of the threads used to knit the base material is void of the first material.

20. The method of claim 13, wherein the slivers includes a central portion, two terminal end portions, and an intermediate portion there between; and capturing slivers within the base material includes wrapping the intermediate portion about a single thread, and trapping the intermediate portion between two other threads.

* * * * *

UNITED STATES PATENT AND TRADEMARK OFFICE

CERTIFICATE OF CORRECTION

PATENT NO. : 6,766,668 B2
DATED : July 27, 2004
INVENTOR(S) : Daniel L. Sinykin

It is certified that error appears in the above-identified patent and that said Letters Patent is hereby corrected as shown below:

Column 5,
Line 54, please replace “haying” with -- having --.

Signed and Sealed this

Twenty-fifth Day of January, 2005

JON W. DUDAS
*Director of the United States Patent and Trademark Office*